United States Patent [19]

Korte et al.

[11] Patent Number: 4,700,722

[45] Date of Patent: Oct. 20, 1987

[54] PROCESS FOR RETAINING ALKALOIDS BY TREATING WITH STRONG ACIDS BEFORE DRYING

[75] Inventors: Kevin R. Korte; Elmer Litzinger, both of Louisville, Ky.; Dan T. Wu, Surabaya, Indonesia

[73] Assignee: Brown & Williamson Tobacco Corporation, Louisville, Ky.

[21] Appl. No.: 861,897

[22] Filed: May 12, 1986

[51] Int. Cl.[4] ..... A24B 15/20; A24B 15/28

[52] U.S. Cl. ..... 131/309; 131/310

[58] Field of Search ..... 131/297, 309, 310

[56] References Cited

U.S. PATENT DOCUMENTS

| | | | |
|---|---|---|---|
| 587,184 | 7/1897 | Cohen | 131/297 |
| 2,164,030 | 6/1939 | Coe | 131/309 |

FOREIGN PATENT DOCUMENTS

| | | | |
|---|---|---|---|
| 0034997 | 3/1978 | Japan | 131/297 |

*Primary Examiner*—V. Millin

*Attorney, Agent, or Firm*—Charles G. Lamb

[57] ABSTRACT

A method of treating tobacco with a strong acid to inhibit alkaloid loss during drying. The tobacco is then treated with weak base to neutralize the acid. The preferred strong acid is phosphoric. The preferred weak base is ammonium hydroxide. An added benefit of this treatment is burn retardation by ammonium phosphates resulting in cigarette puff number increase.

8 Claims, No Drawings

PROCESS FOR RETAINING ALKALOIDS BY TREATING WITH STRONG ACIDS BEFORE DRYING

BACKGROUND OF THE INVENTION

This invention relates to processing of tobacco to reduce alkaloid loss during drying. This invention further relates to a strong acid treatment of tobacco prior to drying.

In the manufacture of tobacco products, the moisture content of cured tobacco is raised to about 20–25% (wet basis) in order to cut the tobacco into shreds without unnecessarily breaking the tobacco into fine particles and dust. However, to further prepare this tobacco for use as a smoking article the cut tobacco is dried to a moisture content of about 14% or lower. During this drying step, alkaloid substances including nicotine are lost through vaporization and the alkaloid loss affects the final characteristics of the tobacco product.

References teaching various means of treatment of tobacco are known and include U.S. Pat. No. 2,914,072, Tyrer and Tyrer, which relates to the treating of poor quality tobacco with a solution of metal salts and a simple aliphatic acid. Certain acids including glycolic and latic are used. However, the reference includes the acidification with a process where the acids are applied to the tobaccos along primary and sometimes secondary catalysts. The primary catalysts include salts of cobalt, maganese, nickel, copper, chromium or silver while the secondary catalysts include salts of potassium, magnesium, barium and sodium. The references teach the use of acids only with the catalysts and the reference specifically states it was found that the catalyst is significantly more effective when the acid is added to the tobacco. The reference teaches addition of acid in the range of from 0% to 5% based on dry weight of the tobacco but generally approximately 1%.

U.S. Pat. No. 4,127,135, Comber, teaches a method of curing and processing tobacco by spraying or infecting the plant stalks or roots of growing plants to accelerate wilting and preventing the leaves from turning brown with various chemicals including phosphorous acid. Additionally, U.S. Pat. No. 2,224,833, Pfvetaer and Lasch, teaches spraying tobacco with solutions of 2% formic acid and solutions of 1.5 to 3.0% hydrochloric acid to prevent the formation of brown spots and then drying the tobacco.

No prior art reference is known which teaches the use of a strong acid, for example, phosphoric acid, to reduce alkaloid loss during tobacco drying; nor do any of the references teach acidification followed by drying where after drying the tobacco is treated with a chemically basic material.

SUMMARY OF THE INVENTION

The present invention provides a method for retaining tobacco alkaloids during processing and more particularly for retaining the alkaloid content of tobacco during a drying process. More particularly, the present invention provides a procedure for treating tobacco with a strong acid before drying and if desired the strong acid can be neutralized with a weak base.

It has been unexpectedly found that this method of treating tobacco will produce a tobacco of increased filling power when compared to an untreated control. Also the present invention provides a method and procedure to treat tobacco to inhibit alkaloid loss during drying or overdrying, while maintaining the fill characteristics of the tobacco when utilized to manufacture tobacco products.

In one example of a process in accordance with the present invention, an all lamina blend of cut tobacco containing 50% burley and 50% flue-cured tobacco was utilized. A quantity of this blend was divided into two equal parts. To one part of the dry tobacco an 85% phosphoric acid solution was applied until the level of acid was 8% by weight of the tobacco on a dry weight basis. The acid solution was applied to the tobacco in a closed rotating cylinder with an atomizing spray. This part was labeled acid treated. To the second part of tobacco only water was applied in a similar manner so that the moisture content of the two parts were essentially equal. The part to which only water was added was labeled control. Both the acid treated and control samples were bulked before being dried. It will be recognized that within the scope of the present invention the aqueous acid solution can be applied onto tobacco strips as part of the process of moistening tobacco prior to cutting. The characteristics of the two samples prior to drying are shown in Table I.

TABLE I

| | Control | Acid Treated |
|---|---|---|
| Moisture (%) | 24.2 | 20.3 |
| Phosphate (% $PO_4$) | 0.9 | 9.2 |
| Filling Value (mg/cc) | 211 | 202 |
| Alkaloids (%) | 3.25 | 3.24 |

The control and the acid treated tobacco were then air dried in accordance with Jewell, et al. as described in U.S. Pat. No. 4,167,191 (dryer wet bulb temperatures were equal to 210° F.) at various dry bulb temperatures and ranges of gas to solids. The results of these tests are compared based on % change from the inlet cut tobacco as shown in Table 2.

TABLE 2

| | High G/S | | Low G/S | |
|---|---|---|---|---|
| | Control | Acid Treated | Control | Acid Treated |
| A. Inlet Gas Temperature of 400° F. | | | | |
| G/S (LB Gas/LB Tobacco) | 34 | 36 | 19 | 20 |
| Filling Value Increase (%) | 9.3 | 17.2 | 8.2 | 7.1 |
| Alkaloids Loss (%) | 7.0 | 2.4 | 5.1 | 0.0 |
| Exit Dryer Moisture (%) | 14.0 | 10.7 | 14.1 | 10.7 |
| +6 Mesh Increase (%) | 75 | 111 | 73 | 79 |
| B. Inlet Gas Temperature of 500° F. | | | | |
| G/S (LB Gas/LB Tobacco) | 29 | 32 | 21 | 17 |
| Filling Value Increase (%) | 11.1 | 18.5 | 11.6 | 12.2 |
| Alkaloids Loss (%) | 8.7 | 3.7 | 5.2 | 0.6 |
| Exit Dryer Moisture (%) | 9.6 | 8.0 | 10.0 | 7.6 |
| +6 Mesh Increase (%) | 63 | 93 | 73 | 82 |
| C. Inlet Gas Temperature of 600° F. | | | | |
| G/S (LB Gas/LB Tobacco) | 30 | 31 | 15 | 15 |
| Filling Value Increase (%) | 22.7 | 34.7 | 20.6 | 22.7 |
| Alkaloids Loss (%) | 15.3 | 14.8 | 12.5 | 10.5 |
| Exit Dryer Moisture (%) | 5.3 | 5.3 | 5.5 | 5.7 |
| +6 Mesh Increase (%) | 9 | 63 | 25 | 30 |

The foregoing demonstrates that the use of phosphoric acid improves the filling value and particle size of the tobacco and reduces the alkaloid loss during drying. Also, that it works under a variety of temperature and G/S conditions. The results are summarized at a LB Gas/LB Tobacco ratio equal to 25 in Table 3.

TABLE 3

| | Inlet Gas Temperature | | | | | |
|---|---|---|---|---|---|---|
| | 400° F. | | 500° F. | | 600° F. | |
| | Control | Acid Treat. | Control | Acid Treat. | Control | Acid Treat. |
| Filling Value Improvement (%) | 8.7 | 10.2 | 11.2 | 15.6 | 22.0 | 30.0 |
| Alkaloid Loss | 5.8 | 0.8 | 6.9 | 2.2 | 14.4 | 13.2 |
| +6 Mesh Increase (%) | 74 | 89 | 68 | 87 | 14 | 51 |

In all three cases the FVI and particle size was improved while alkaloid losses were reduced. Comparing the results based on alkaloid loss at a 20% equivalent increase in filling value, the acid treated tobacco experienced a loss of 4.2% while the water treated only control sample lost 12.8% alkaloids thus demonstrating the effectiveness of the treatment.

In another experiment to determine the effect of various levels of acid addition, various levels of acid were applied and dried in a similar manner as the previous example. The results are shown in Table 4 Results as based on alkaloid loss at an equivalent increase in filling value.

TABLE 4

| Effect of Varying Levels of Acid Addition | | | |
|---|---|---|---|
| | Alkaloid Content (%) | | |
| Wt % $H_3PO_4$ Added | Before Drying | After Drying | % Alkaloid Loss During Drying |
| 0 | 3.11 | 2.24 | 28 |
| 4 | 2.93 | 2.31 | 21 |
| 8 | 2.60 | 2.33 | 10.4 |
| 16 | 2.53 | 2.36 | 6.7 |

The results confirm the beneficial effect of the use of phosphoric acid treatment as a means of preventing undesirable alkaloid loss during tobacco drying while maintaining expansion properties. The results also demonstrate the ability to tailor the reduction in alkaloid loss by adding various levels of acid The fourth sample of Table 4 which had been treated with 16% phosphoric acid prior to drying was then reordered using an aqueous ammonia solution to increase the moisture content to 13.5%. Test cigarettes were made with 6% inclusion of the aqueous ammonia reordered tobacco, and 94% inclusion of a cut tobacco blend. These were compared to a control cigarette sample which contained 100% of the same cut tobacco blend. Results are shown in Table 5. Note that the Test cigarette shows a 0.4 puff number increase, even though the density is 6% lower than the Control. Per puff deliveries of tar, nicotine and CO are roughly the same for test and control. The data show that the combination of the phosphoric acid and ammonia treatment produces a slow burning tobacco which significantly increases puff count at reduced density and maintains per puff deliveries at a constant level.

TABLE 5

| | Cigarette Samples | |
|---|---|---|
| | Control | Test |
| % Treated Tobacco | 0 | 6 |
| Dry Density (mg/cc) | 209 | 197 |
| Puff Number | 6.9 | 7.3 |
| Tar (mg/puff) | 0.86 | 0.88 |
| Nicotine (mg/puff) | 0.075 | 0.075 |
| CO (mg/puff) | 1.03 | 1.03 |

While phosphoric acid was utilized in the process evaluation, it is recognized that any strong acid which is non-volatile, heat resistant and non-toxic with desirable taste characteristics can be utilized. However, hydrochloric, nitric and sulfuric acids were not considered desirable. Citric acid was also found to provide improved alkaloid loss characteristics.

It is recognized that modifications can be made in the described process without departing from the spirit and scope of this invention.

What is claimed is:

1. A process of treating tobacco to inhibit alkaloid loss comprising the steps of:

adding a selected quantity of an aqueous solution of a strong acid to a selected quantity of tobacco;

drying the tobacco until the moisture content is less than 16 percent by weight of the tobacco; and adding an aqueous solution of a weak base in a sufficient amount to neutralize the added acid.

2. The process of claim 1 wherein the quantity of strong acid is in the range of about 4% to about 16% by weight of the tobacco on a dry weight basis.

3. The process of claim 1 wherein the strong acid is phosphoric acid.

4. The process of claim 1 wherein the strong acid is citric acid.

5. The process of claim 1 wherein the strong acid is added to said tobacco as an aqueous solution.

6. The process of claim 1 wherein said drying is accomplished by contacting said treated tobacco with heated air in a moving gas stream.

7. The process of claim 6 wherein said air stream has a wet bulb temperature of 210° F.

8. The process of claim 1 wherein said aqueous basic solution is aqueous ammonia.

* * * * *